US006813986B1

(12) United States Patent
Tafoya et al.

(10) Patent No.: US 6,813,986 B1
(45) Date of Patent: Nov. 9, 2004

(54) REUSABLE BOMB DIFFUSER

(75) Inventors: Samuel Barran Tafoya, Bradenton, FL (US); Hans Guenter Broemel, Bradenton, FL (US)

(73) Assignee: Counterterrorism Technologies Corporation, Sarasota, FL (US)

( * ) Notice: Subject to any disclaimer, the term of this patent is extended or adjusted under 35 U.S.C. 154(b) by 0 days.

(21) Appl. No.: 10/724,289

(22) Filed: Nov. 27, 2003

(51) Int. Cl.[7] ..... F42B 33/00; F41H 13/00
(52) U.S. Cl. ..... 86/50; 89/36.07
(58) Field of Search ..... 86/50; 89/1.1, 89/36.07, 36.17; 109/1 R, 1 S, 1 V, 49.5, 78, 80, 81

(56) References Cited

U.S. PATENT DOCUMENTS 1,761,095 A * 6/1930 Spottswood ..... 109/12
2,315,800 A * 4/1943 Rochester et al. ..... 109/23
2,404,441 A * 7/1946 Hopkins ..... 89/1.1
3,820,479 A * 6/1974 Fylling ..... 109/1 R
3,905,272 A * 9/1975 Johnson ..... 89/1.1
4,389,947 A * 6/1983 King et al. ..... 109/1 S
4,632,041 A * 12/1986 Ohlson ..... 109/1 S
4,727,789 A * 3/1988 Katsanis et al. ..... 86/50
4,836,079 A * 6/1989 Barrett ..... 86/50
5,405,673 A * 4/1995 Seibert ..... 428/137
5,452,641 A * 9/1995 Kariya ..... 89/36.14
5,712,441 A * 1/1998 Grunewald ..... 89/1.13
5,864,767 A * 1/1999 Drumgoole et al. ..... 588/202

* cited by examiner

*Primary Examiner*—Michael J. Carone
*Assistant Examiner*—Bret Hayes
(74) *Attorney, Agent, or Firm*—Dorothy S. Morse

(57) ABSTRACT

A reusable bomb diffusing device having a core structure with outer surfaces covered by outwardly extending and increasingly upwardly-directed energy-absorbing vanes that are fixed in position and separated from one another by approximately 3°, the core structure being centered within an outer chamber having solid side walls and a mesh top surface through which the rapidly expanding gases from a blast are exhausted. A central bottom opening in the present invention permits placement directly over a bomb, with movement of the device to a bomb's location being accomplished manually or via attachment to a motorized vehicle. Expanding gases within the core structure are directed to the vanes in vector geometry fashion, which reduces the gases' energy and drives them upward to exit the outer chamber through the openings in its mesh top. During detonation, the present invention device remains substantially in its pre-explosion position. Police and military applications are contemplated.

20 Claims, 6 Drawing Sheets

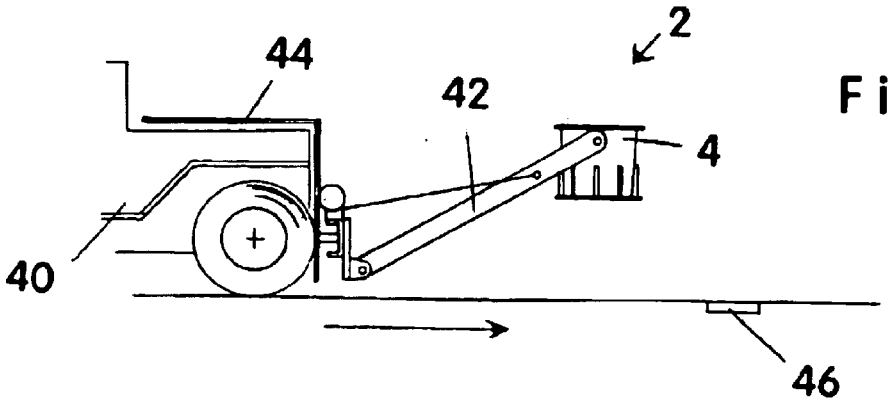
Fig. 8
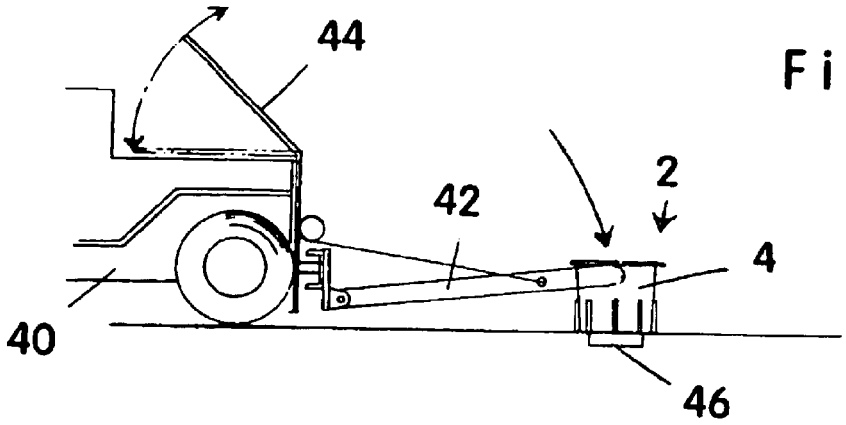
Fig. 9
Fig. 10
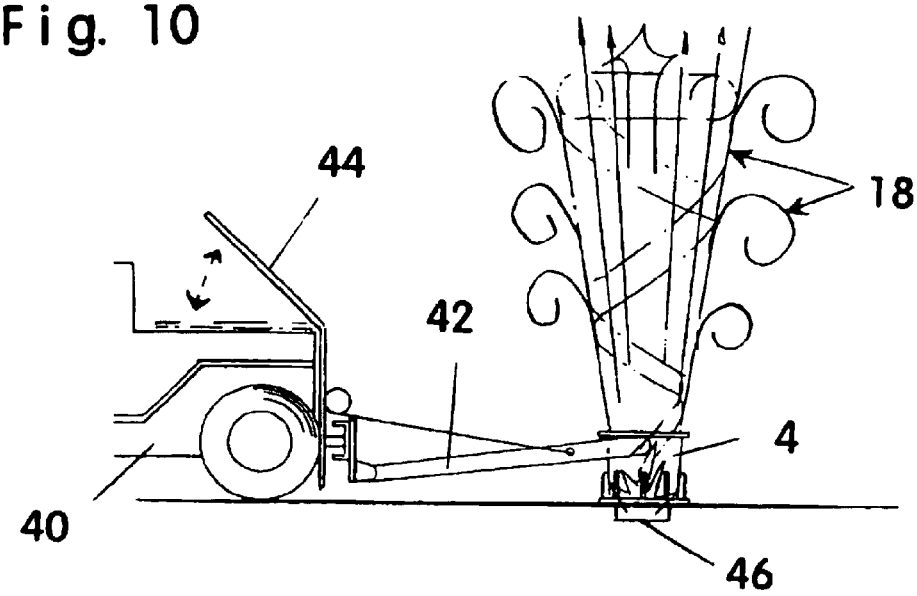

REUSABLE BOMB DIFFUSER

CROSS-REFERENCES TO RELATED APPLICATIONS

None.

BACKGROUND OF THE INVENTION

1. Field of the Invention

This invention relates to the field of explosion neutralizing devices used to safely contain and/or redirect the energy released by exploding bombs and land mines, specifically to a reusable bomb diffusing device having a core structure with all outer surfaces covered by a series of outwardly-extending and progressively upwardly-directed energy-absorbing vanes that are each fixed in position and separated from the next adjacent vane by an angle of approximately 3°, the device also having an outer chamber with solid side walls and a mesh top surface through which the fine debris and rapidly expanding gases from a blast is exhausted. A central bottom opening in the present invention permits placement directly over a bomb. Thus, it is moved to the location of a bomb, eliminating the inherent dangers associated with transport of a bomb to remote location for controlled detonation. Smaller present invention devices can be manually moved through the use of an upper handle, dolly, or other wheeled platform, while larger present invention devices can be adapted for movement via temporary or permanent attachment to a motorized vehicle. After detonation, the air/gases immediately surrounding the exploded device expands within the core structure and is directed to the vanes in vector geometry fashion, which reduce the gases' energy and drive them upwards to exit the outer chamber through openings in its mesh top. After detonation, the present invention device remains substantially in its pre-explosion position and in an undamaged condition ready for subsequent use. Police and military applications are contemplated.

2. Description of the Related Art

The police and military personnel worldwide are repeatedly exposed to a risk of injury due to unexploded bombs and land mines, as are private citizens in certain countries recently affected by war. A variety of methods and devices have been used to either detonate the explosives in a controlled manner, or render them inert to allow for their safe disposal. Such methods and devices include but are not limited to spraying explosives with cryogenic materials to render them temporarily inert and allow for their safe disposal, remote activation systems that permit detonation at a safe distance, pre-detonation devices that initiate controlled burning of an explosive charge to avoid or lessen its detonation impact, microwave energy exploding devices that can be operated at a safe distance, use of small animals such as rats to seek out and destroy active mines or unearth and mark them for later removal, and neutralizing devices that comprise a housing placed over an explosive device with a casing and include at least one explosive charge that penetrates and opens the casing and forces reactive material into the explosive device to neutralize it without detonation. All of these known devices and methods have some disadvantage, such as special handling requirements, great expense, time consuming animal training, and the like. In contrast, the shape and construction of the present invention utilizes physics to redirect explosive forces. Thus, the present invention is typically undamaged by an explosion and repeatedly reusable without interim refurbishment or routine maintenance, the present invention can be used in areas having structures such as trees, buildings, fences, and motorized vehicles nearby without damage to such structures, and it can be moved to the site of a land mine or other explosive device via a motorized vehicle and remotely lowered into place. Further, it can be simply and relatively inexpensively made. There is no bomb diffusing device known with the same features and components as the present invention, nor all of its explosion neutralizing advantages.

BRIEF SUMMARY OF THE INVENTION—OBJECTIVES AND ADVANTAGES

The primary object of this invention is to provide a reusable bomb diffuser that is able to eliminate the safety hazards posed by non-detonated ordnance such as bombs and land mines, as well as other explosive devices, by detonating them in a controlled environment that is configured to reduce the velocity of the expanding gases and debris generated by the detonation while concurrently redirecting all laterally moving gases and debris for release in a substantially upward direction. It is also an object of this invention to provide a reusable bomb diffuser that can be repeatedly reused without interim refurbishment or maintenance. A further object of this invention is to provide a reusable bomb diffuser that can be used while remaining attached to a motorized vehicle. It is also an object of this invention to provide a reusable bomb diffuser that during detonation does not move substantially from its pre-detonation position. A further object of this invention is to provide a reusable bomb diffuser that is easy to construct and simple to use. It is also an object of this invention to provide a reusable bomb diffuser that is cost efficient to make and use when compared to the costs associated with other ordnance elimination devices.

As described herein, properly manufactured and used, the present invention is a repeatedly reusable explosion neutralizing device that is constructed to completely cover the top and sides of a bomb at the time of ignition, or be placed over the identified site of buried ordinance, such as a land mine. Its size is adapted during manufacture according to the intended explosives or ordnance use. The cumulative design of the vanes outwardly directed from its core structure and separated from one another in 3° increments, cause the lower vanes to be placed in a substantially horizontally-extending position and the upper vanes to be aimed in a substantially vertically-extending position. Such positioning allows for nearly all of the outwardly expanding debris and gases from detonation to be driven upwards and reduced in energy by the vanes, with the walls of the outer chamber redirecting the gases and fine debris ii hitting it toward the mesh openings in the outer chamber's top surface. Bernoulli's Law states that "when a gas is accelerated, its pressure and temperature drop". Thus, the gases within the core structure of the present invention are forced outward beyond the vanes and upward at a reduced velocity, as well as against the solid side walls of the outer chamber at a reduced velocity. After total expansion, the radiant gases exiting the core structure between the vanes will cause an implosive reaction within the core structure as the incoming gases equalize pressures therein back to atmospheric pressure. Further, since according to Newton's third law "For every action there is an equal and opposite reaction", and since the upwardly directed gases move through the top mesh at a reduced velocity, the outer chamber is held to the ground instead of being vertically lifted during a detonation. The vanes are at least one-eighth of an inch thick, to prevent their collapse during use. Although attachment of the vanes could theoretically be by any means able to withstand the maximum explosive forces anticipated during use, the vanes in the most preferred embodiment of the present invention are welded in place against the core structure. Thus, the present invention safely redirects the expanding gases released by a bomb, land mine, or other ordnance, and during an explosion the outer chamber does not move substantially from its pre-detonation position. Since the vanes deflect expanding gases through the spaces between them, and the solid side walls of the outer chamber are impacted by gases having a reduced velocity, the core structure and outer chamber are not damaged during use and can be reused many times without interim refurbishment or maintenance. The reduced velocity also causes a change in direction for laterally moving larger particulate debris after it passes between the vanes, whereby it tends to accumulate on the bottom surface of the outer chamber between its solid side walls and the base of the core structure therein, instead of moving upward and through the mesh openings in the outer chamber's top surface. Since the present invention does not move significantly during a detonation, it could be used while attached to a motorized vehicle as long as safety shield is placed over any vehicle windows directly facing the outer chamber. Since the present invention has no motor, no moving parts, and a simple design, it is easy to construct. It is also safety enhancing and simple to use. Instead of the people wanting explosive device detonation having to move it to a containment device, the present invention is readily and promptly movable into position directly over the explosive device via a handle, rod or pole, or motorized vehicle that can remotely lower the present invention over the explosive device. Detonation of an explosive device positioned under the present invention can be activated remotely, whereafter all of the gases exiting the outer chamber do so through the mesh openings in its top surface. Although the outer chamber could have many configurations, a conical configuration with a circular cross-section is preferred, as such a structure permits a thinner wall dimension than would be required for an outer chamber having the cross-sectional configuration of a rectangle or other closed angular structure.

While the description herein provides preferred embodiments of the present bomb diffuser invention, it should not be used to limit its scope. For example, variations of the present invention, while not shown and described herein, can also be considered within the scope of the present invention, such as variations in the number, placement, and size of the reinforcement stiffeners used against the solid side walls of the outer chamber; the type of material used to make the core structure and outer chamber; the configuration of the openings in the mesh top of the outer chamber; the height, width, and length dimensions of the core structure and the outer chamber; the configuration of the portion of the core structure supporting the vanes; the type of attachment means used with the outer chamber for its movement from one location to another between detonation uses; and the number and thickness of the vanes attached to the core structure. Thus, the scope of the present invention should be determined by the appended claims and their legal equivalents, rather than being limited to the examples given.

BRIEF DESCRIPTION OF THE SEVERAL VIEWS OF THE DRAWINGS

FIG. 8 is a side view of the first preferred embodiment being attached to the front end of a motorized vehicle that is moving toward an explosive device buried in the ground.

FIG. 9 is a side view of the first preferred embodiment remaining attached to the front end of a motorized vehicle as it is lowered over the explosive device.

FIG. 10 is a side view of the first preferred embodiment remaining attached to the front end of a motorized vehicle while the explosive device within the outer chamber is detonated.

DETAILED DESCRIPTION OF THE INVENTION

Figure 1:
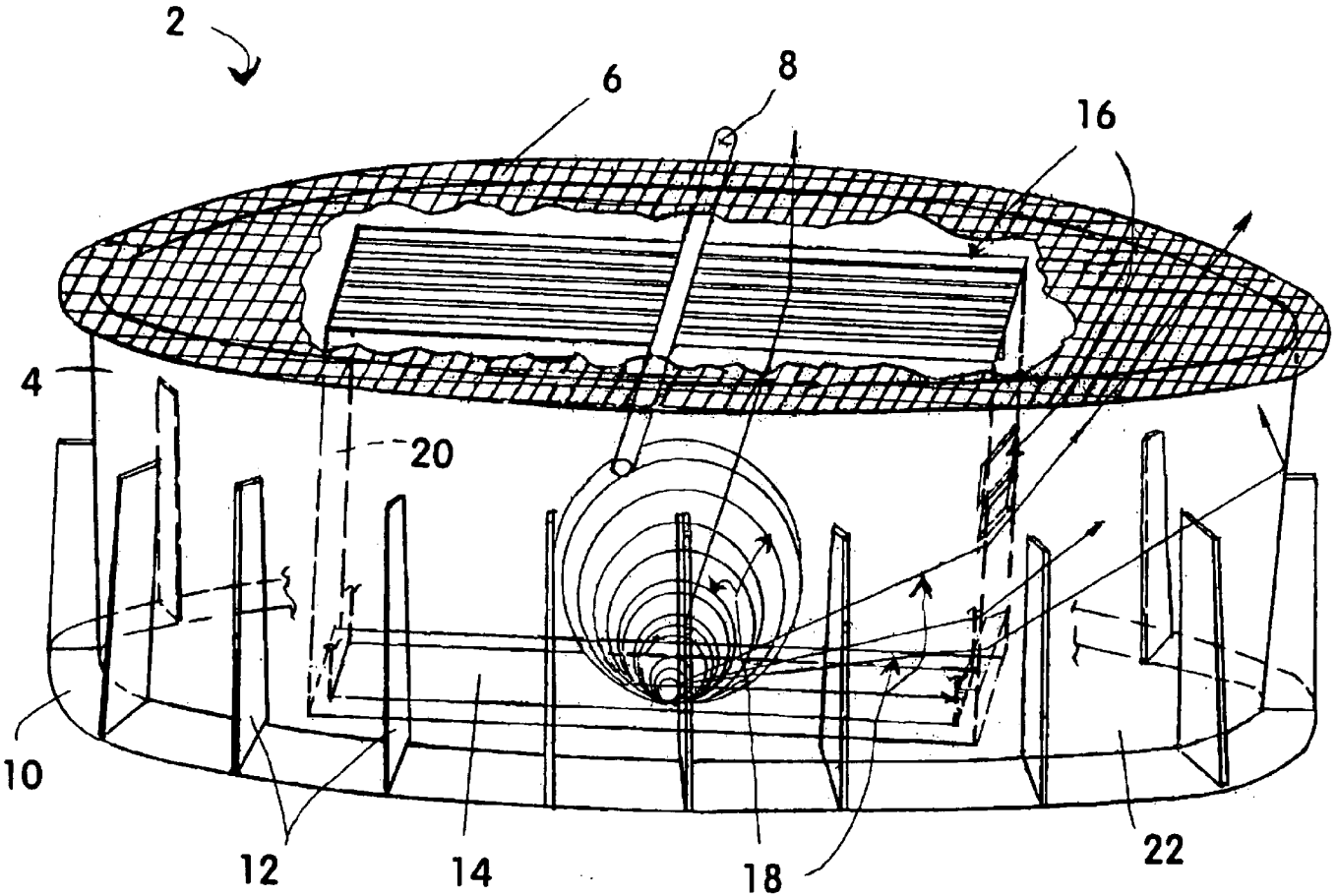
FIG. 1 is a perspective of the most preferred embodiment of the present invention bomb diffuser having a core structure centered within an outer chamber having solid side walls, non-movable reinforcement stiffeners attached to the outside surface of the walls, and a mesh top.

The present invention is a repeatedly reusable explosion neutralizer that is constructed to completely cover at the time of ignition the top or top and sides of a bomb, other explosive device, or ordnance (such as but not limited to the land mine 46 shown in FIGS. 8–10). Its size is adapted during manufacture according to the intended explosives or ordnance application. Thus, a present invention device intended for use in detonating satchel bombs would typically be larger that present invention devices used only for detonation of pipe bombs. All embodiments of the present invention have a core structure 20 secured within an outer chamber 4 and fixed vanes 16 securely attached to the sides, or top and sides, of core structure 20. The cumulative design of the vanes 16 outwardly directed from core structure 20 are separated from one another in 3° increments and cause the lower vanes 16 to be placed in a substantially horizontally-extending position and the upper vanes 16 to be aimed in a substantially vertically-extending position. Such positioning allows for nearly all of the outwardly expanding debris and gases (shown by force lines 18 in FIGS. 1 and 6) that result from detonation of an explosive device within or completely under core structure 20 to be reduced in energy and driven upwards by the vanes 16, with the solid side walls of the outer chamber 4 redirecting the gases and fine debris hitting it toward the mesh openings in the outer chamber's top surface 6. Once the upwardly directed fine debris and gases leave outer chamber 4 through the mesh openings in top surface 6, an upward moving Karmen vortex ring is formed that further reduces the energy of the expanding gases. In contrast, the reduced velocity of the gases causes any coarse debris to fall to the bottom surface 22 of outer chamber 4. During the detonation of an explosive device within or under core structure 20, outer chamber 4 does not move significantly from its pre-detonation position, even if the explosive device to be detonated (such as but not limited to the land mine 46 shown in FIGS. 8 and 10) is not completely centered within or under core structure 20. Since the vanes 16 deflect expanding debris and gases through the spaces between them, and the walls of the outer chamber 4 are impacted by gases having a reduced velocity, the core structure 20 and outer chamber 4 are not damaged during use and can be reused many times. Since the present invention has no motor, no moving parts, and a simple design, it is easy to construct. It is also safety enhancing and simple to use. Instead of the people who desire detonation or neutralization of an explosive device having to move the device to a protective container, the present invention is readily and promptly movable into a position directly over the explosive device via a handle 28 (such as but not limited to that shown in FIGS. 6 and 7), a rod or pole 8 (such as but not limited to that shown in FIG. 1), or a motorized vehicle 40 (such as but not limited to that shown in FIGS. 8–10). Detonation of an explosive device positioned under the present invention can be activated remotely, whereafter all of the fine debris particulate and gases exiting the outer chamber 4 do so through the mesh openings its top surface 6.

Figure 2:
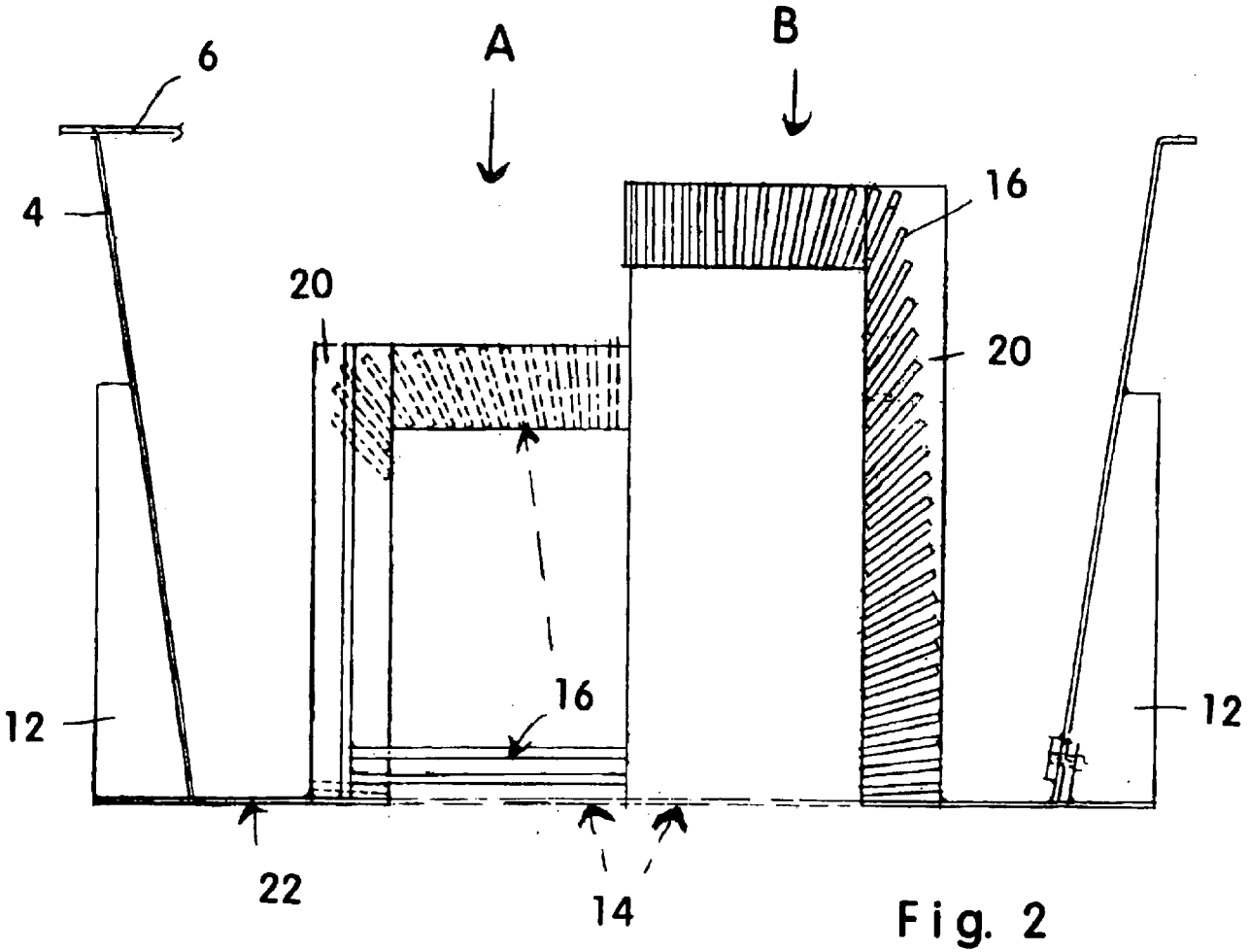
FIG. 2 is a sectional view of the most preferred embodiment of the present invention bomb diffuser having in the alternative a core structure 'B' that is nearly the full height of the outer chamber, or a core structure 'A' that is significantly less than the full height of the outer chamber.

FIGS. 1 and 2 show the most preferred embodiment 2 of the present invention bomb diffuser having a core structure 20 centered within an outer chamber 4 having solid side walls, a flange 10 outwardly extending from the bottom surface 22 of outer chamber 4, a mesh top surface 6, and a plurality of reinforcement stiffeners 12 attached to flange 10 and the outside surface of the solid side walls of outer chamber 4. Although the number, shape, and size of reinforcement stiffeners 12 can vary as long as they are able to successfully perform their reinforcement function, the preferred size, positioning, and construction of reinforcement stiffeners 12 is shown in FIG. 1. Further, although the materials used for outer chamber 4, core structure 20, bottom flange 10, and reinforcement stiffeners 12 can be the same, such as armor plate or cold rolled steel, the materials used during manufacture for such present invention components can also be different to meet cost and intended application requirements. FIGS. 1 and 2 also show outer chamber 4 having a bottom surface 22 between core structure 20 and the solid side walls of outer chamber 4, and a bottom opening 14 centered within core structure 20 and through which an explosive device such as but not limited to land mine 46 is introduced into or placed in communication with the interior of core structure 20. In FIGS. 1 and 2, a few representative vanes 16 are shown attached to core structure 20, however, during manufacture vanes 16 would be made to extend across all outer surfaces of core structure 20, similar to the configuration of vanes 16 shown in FIG. 7. FIG. 2 shows that the height of core structure 20 can vary during manufacture as needed for particular applications, with core structure 20B having nearly the fill height of outer chamber 4 and useful for detonation of satchel bombs or equivalent explosive charges, and core structure 20A being approximately two-thirds of the full height of outer chamber 4 and being appropriate for detonation of pipe bombs or equivalent explosive charges. However, FIG. 2 is only used to provide a side-by-side comparison of two alternative core structures 20 so as to show their relative height with respect to outer chamber 4, and it should be understood that in any given embodiment of the present invention, the sides of each core structure 20 used would all have the same height dimension for even distribution of outwardly expanding gases and debris within outer chamber 4 and stable positioning of outer chamber 4 during the detonation of an explosive device within its attached core structure 20. Further, although outer chamber 4 could have many configurations, such as but not limited to that the conical outer chamber 4 shown in FIG. 2 or the rectangular outer chamber 4 shown in FIGS. 6 and 7, the conical configuration with a circular cross-section that is shown in FIGS. 1 and 2 is preferred, as such a structure permits a thinner wall dimension than would be required for an outer chamber 4 having a rectangular or other angular closed configuration. According to Bernoulli's Law, which states that "when a gas is accelerated, its pressure and temperature drop", the gases within core structure 20 are forced outward beyond vanes 16 and upward at a reduced velocity, as well as against the solid side walls of outer chamber 4 at a reduced velocity. In addition, after total expansion, the radiant gases exiting core structure 20 between vanes 16 will cause an implosive reaction within core structure 20 as the outgoing gases equalize pressures therein back to atmospheric pressure. Further, since according to Newton's third law"For every action there is an equal and opposite reaction", and since the upwardly directed gases move through the mesh openings in top surface 6 at a reduced velocity, outer chamber 4 is held to the ground instead of being vertically lifted during a detonation. The mesh openings in top surface 6 are not limited to the rectangular configuration shown in FIG. 1, and can be hexagonal (as shown in FIG. 7), substantially diamond-shaped as in catwalk material (not shown), or any other configuration that can rapidly exhaust the expanding gases caused by an explosion originating within core structure 20. FIGS. 8–10 show the first embodiment 2 of the present invention being secured to the front end of a motorized vehicle 40 and remaining attached to motor vehicle 40 during detonation.

Figure 4:
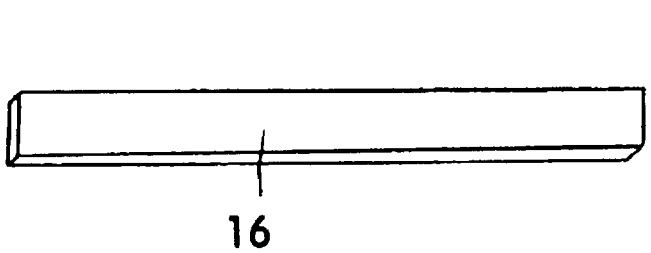
FIG. 4 is a perspective view of one of the vanes in the most preferred embodiment of the present invention bomb diffuser.
Figure 5:
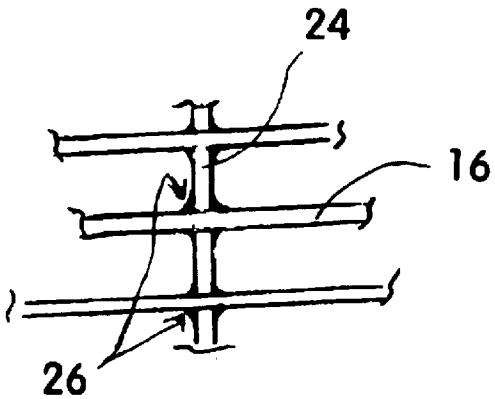
FIG. 5 is a front view of several vanes in the most preferred embodiment of the present invention bomb diffuser attached to a vertically extending rib.
Figure 3:
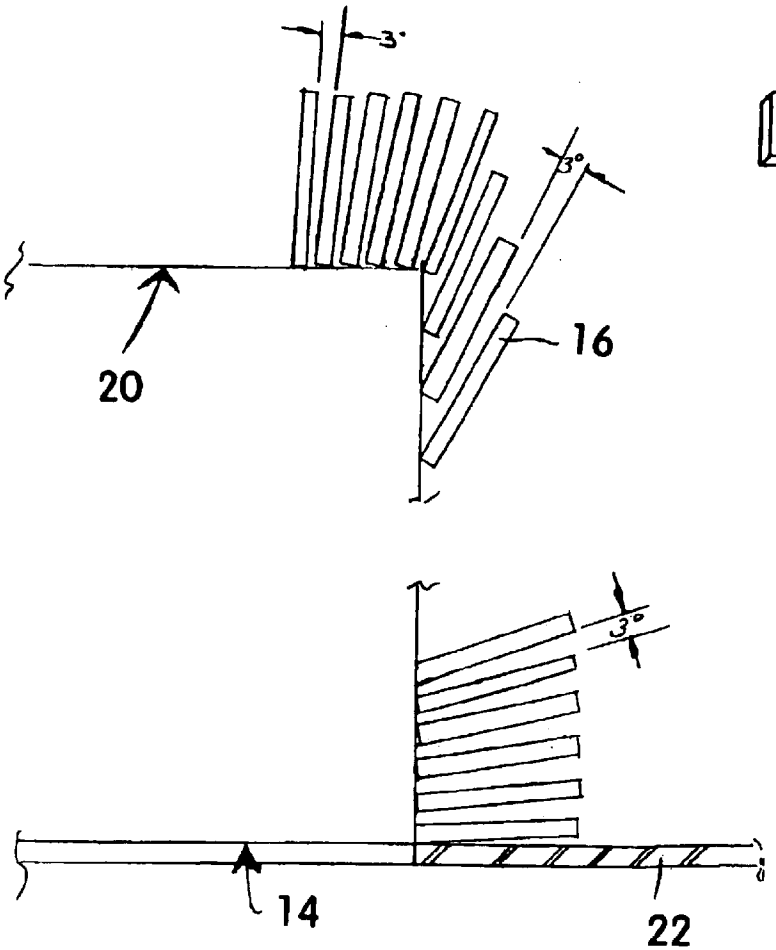
FIG. 3 is a schematic view of the most preferred embodiment of the present invention bomb diffuser showing the 3° placement of the adjacent energy-diffusing vanes fixed to the outside surface of the core structure.

FIG. 3 shows the approximate three-degree placement of adjacent energy-diffusing vanes 16 from one another on the outside surface of core structure 20 in the most preferred embodiment 2 of the present invention, while FIGS. 4 and 5 respectively show the preferred rectangular cross-sectional configuration for vanes 16 and the attachment of vanes 16 to a vertically extending rib 24 via multiple welds 26. The vanes 16 are at least one-eighth of an inch thick, but preferably have a one-fourth inch thickness dimension to prevent their collapse during use. The preferred rectangular cross-section of vanes 16 gives them their durability. Vanes 16 having a tapering configuration would be at a high risk for erosion and detachment from core structure 20 or 36 during a detonation, and should not be used. Although attachment of the vanes 16 could theoretically be by any means able to withstand the maximum explosive forces anticipated during detonation use, the vanes 16 in the most preferred embodiment 2 of the present invention are held in place against the core structure 20 by multiple welds 26.

Figure 6:
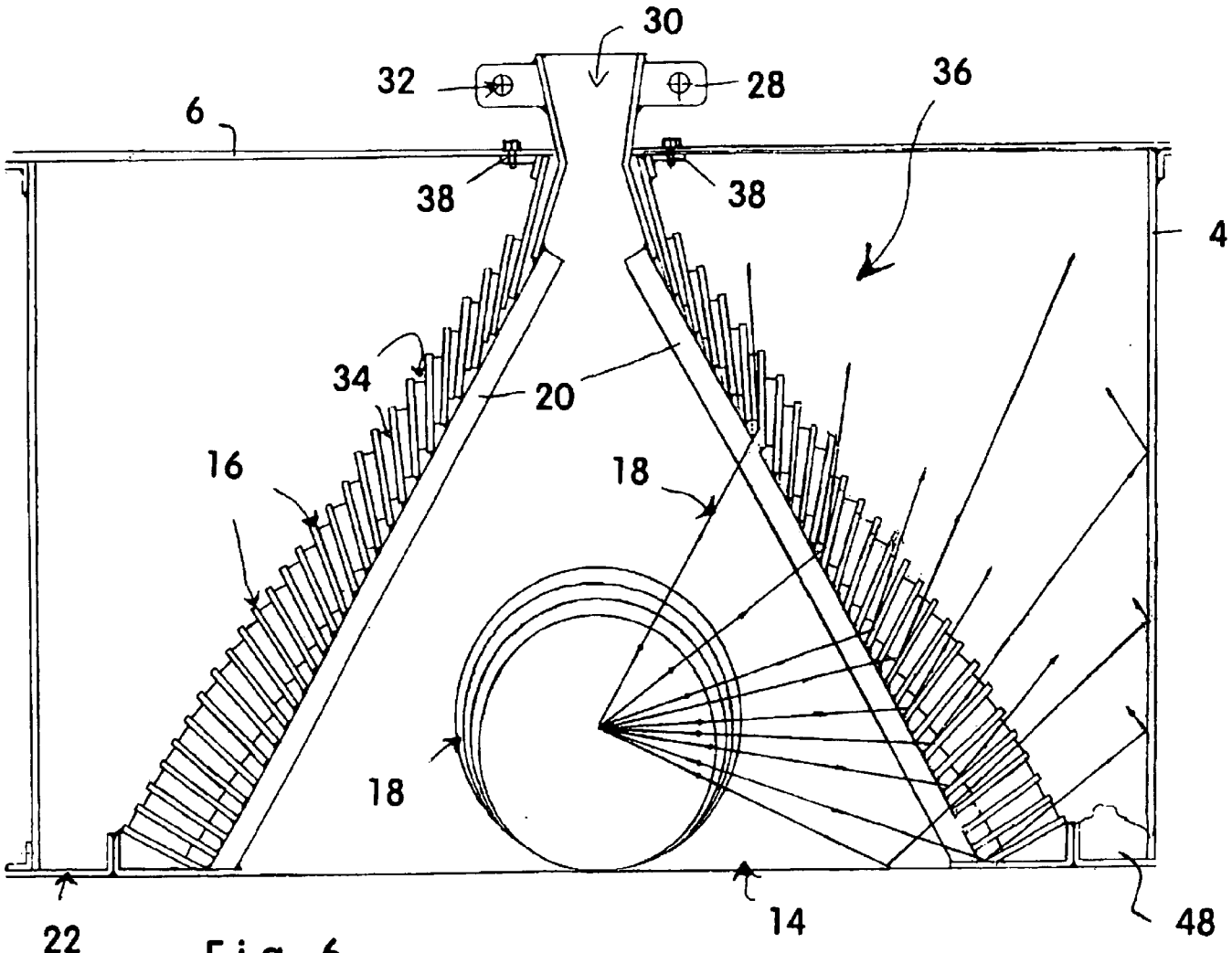
FIG. 6 is a sectional view of a second preferred embodiment of the present invention bomb diffuser having a pyramid-shaped core structure.
Figure 7:
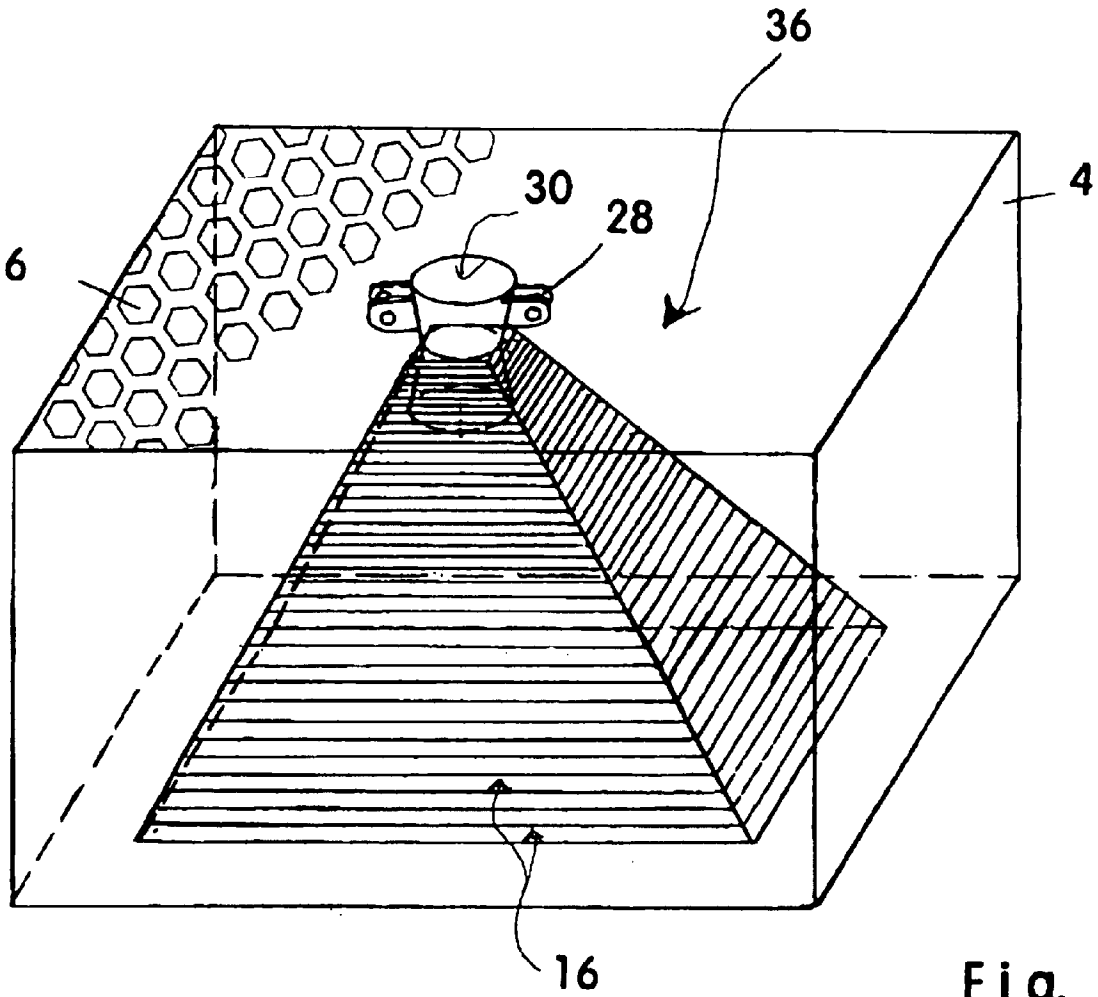
FIG. 7 is perspective view of the second preferred embodiment with its core structure positioned so that its handle extends above the mesh top surface of the outer chamber.

FIGS. 6 and 7 show a second preferred embodiment of the present invention bomb diffuser invention having a pyramid-shaped member 36 with a core structure 20. Theoretically, core structure 20 could have the cross-sectional configuration of any closed polygon that would result in more than the four sides shown in FIGS. 1 and 7, however doing so would increase the manufacturing cost of the present invention by the amount of labor required to attach the additional vanes 16 required and the amount of labor and materials needed to strengthen the less structurally sound multi-sided core structures 20 that are inherently weaker due to the presence of additional joints. Although the outer chambers 4 in FIGS. 6 and 7 are shown to be rectangular, they can also be conical, as shown in FIGS. 1 and 2, or have other reinforced cross-sectional configurations (not shown). FIG. 6 shows the lines of force 18 from an explosion moving between vanes 16 and all lines of force 18 being upwardly directed after movement through vanes 16. Some of the expanding gases and debris represented by the lines of force 18 are deflected from the inside wall surface of outer chamber 4 toward the mesh openings in top surface 6. At least one vertically-extending rib 24 (such as but not limited to that shown in FIG. 5) would be used on each side of pyramid-shaped substitute core member 36 to hold vanes 16 is securely in place during an explosion. FIG. 6 shows a web structure 34 connecting adjacent vanes 16 and a fastening/reinforcement means 38 used to secure the upper portion of core member 36 to the portion of top surface 6 directly adjacent thereto. FIG. 7 also shows the mesh openings in top surface 6 having a hexagonal configuration. The size and configuration of the openings in top surface 6 is limited only by the need for them to rapidly exhaust expanding gases and debris caused by a detonation within core structure 20. FIGS. 6 and 7 both show a handling member 28 with a venturi opening 30 that can be used to insert a means of igniting the explosive device covered by core structure 20. For safety considerations, it is contemplated for the ignition means used (not shown) to be remotely activated. Handling member 28 extends above the mesh openings in top surface 6, and further has multiple outward projections each having at least one bore 32 therethrough that sized for the insertion of a rod or pole, such as but not limited to the rod 8 shown in FIG. 1, for manual transport of the combined outer chamber 4 and core structure 20 from one location to another as needed for explosives and/or ordnance detonation. In addition, although not shown, outer chamber 4 could be manually transported by a wheeled dolly, other wheeled platform, or hand truck, or in the alternative could be temporarily or permanently attached to a motorized vehicle, such as but not limited to the motor vehicle 40 shown in FIGS. 8–10, for transport from the location of one non-detonated explosive device to another, such as but not limited to the land mine 46 also shown in FIGS. 8–10. If the present invention is used for detonation while still attached to a vehicle, and once the present invention is lowered into position over an explosive device, for safety purposes it is recommended that a shield be placed over any vehicle window facing outer chamber 4. Although explosions typically create fine debris particulate, FIG. 6 shows that at least some of the more coarse explosion debris 48 could be expected to accumulate upon bottom surface 22 between vanes 16 and the inside surface of the solid side walls of outer chamber 4.

FIGS. 8–10 show the most preferred embodiment 2 being attached to the front end of a motorized vehicle 40 with a movable safety shield 44 that can be raised for protection of the windshield of motorized vehicle 40 during detonation. Although not shown, most preferred embodiment 2 could be attached to any other side or part of motor vehicle 40 convenient to the application. Further, motor vehicle 40 is not restricted to the truck shown in FIGS. 8–10 and can be any sturdy vehicle capable of transporting in a lifted position the combined weight of outer chamber 4 and core structure 20 or 36, such as but not limited to a variety of military vehicles, including tanks. FIGS. 8–10 further show a remotely operated system 42 adapted for raising and lowering most preferred embodiment 2 that is connected between motorized vehicle 40 and outer chamber 4. Any sturdy system capable of repeatedly raising and lowering the weight of outer chamber 4 and core structure 20 or 36 can be employed. FIG. 8 shows motorized vehicle 40 moving toward a non-detonated explosive device 46. Safety shield 44 is in a lowered position and outer chamber 4 is connected to the distal end of vertical movement system 42 and is in a raised position that does not interfere with efficient movement of motor vehicle 40. FIG. 9 shows outer chamber 4 still connected to the distal end of vertical movement system 42, but now in a lowered position centered over non-detonated explosive device 46. Centered position of explosive device 46 within core structure 20 or 36 is preferred, but not critical. Vertical movement system 42 is still connected to motorized vehicle 40, and safety shield 44 is now in a raised position that provides a barrier between the windshield of motorized vehicle 40 and the expanding gases and debris represented by the force lines 18 in FIG. 10. FIG. 10 shows outer chamber 4 still connected to the distal end of vertical movement system 42 while explosive device 46 is being detonated, with safety shield 44 also remaining in its raised protective position between outer chamber 4 and the windshield of motorized vehicle 40. Forces lines 18 represent the substantially upward movement of expanding gases and fine debris resulting from the detonation of explosive device 46. Outer chamber 4 does not move significantly from its pre-detonation position, which allows it to remain attached to the distal end of vertical movement system 42 during detonation. As mentioned before, in the alternative, movement of outer chamber 4 can be made by manual means rather than by motorized means, such as but not limited to the use of a rod or pole 8 inserted through outer chamber 4, as shown in FIG. 1 and which would require at least two people to manipulate, or alternatively through the use of poles or rods 8 inserted through openings 32 in the handle 28 shown in FIGS. 6 and 7, which would also require lifting by at least two people. Further, although not shown, a non-motorized dolly, other wheeled platform, or hand truck could be used by one person to place outer chamber 4 in its usable position.

The explosion neutralizing capability of the most preferred embodiment 2 shown in FIGS. 1, 2, and 8–10 has been successfully tested, as recorded on film, by the Manatee County Sheriff's Department in Bradenton, Florida, by detonating the equivalent of three sticks of dynamite within core structure 20 that were each approximately two inches in diameter and twelve inches in length. The test was made in a field having a tree, fence, equipment, and farm animals nearby, with the tree, fence, equipment, and animals sustaining no injury or damage as a result of the detonation.

We claim:

1. A reusable bomb diffuser for use in neutralizing the potentially harmful affects of exploding gases and debris resulting from the detonation of a land mine or other exploding device housed under or therein, so that the velocity of expanding gases is slowed and the laterally moving gases and debris are set on an upward course for release from said diffuser in a substantially upward direction, said bomb diffuser comprising:

an outer chamber with solid side walls and a top surface with multiple openings therethrough;

a core structure centered within said outer chamber and firmly secured to said, outer chamber, said core structure having a bottom surface with an opening through said bottom surface; and a plurality of vanes each attached to said core structure with progressive separation of approximately three degrees whereby the lowest ones of said vanes are substantially horizontally-extending and the highest ones of said vanes are substantially vertically-extending, and further whereby the velocity of expanding gases from an explosion within said core structure is reduced by said vanes and directed upwardly for eventual exiting via said multiple openings in said top surface.

2. The diffuser of claim 1 wherein said solid side walls have an outside surface and further comprising a plurality of reinforcement stiffeners attached to said outside surface.

3. The diffuser of claim 2 further comprising a bottom flange attached to said outer chamber and wherein said reinforcement stiffeners are also attached to said bottom flange.

4. The diffuser of claim 1 wherein said top surface has an opening communicating with a venturi configured for introducing into said core structure ignition causing means adapted for setting off a non-detonated exploding device covered by said core structure.

5. The diffuser of claim 1 further comprising a transport means adapted for facilitated movement of said outer chamber from one needed location to another.

6. The diffuser of claim 5 wherein said transport means also provides reinforcement of said side walls of said outer chamber.

7. The diffuser of claim 1 wherein said transport means is selected from a group consisting of motorized vehicles, movement means adapted for remotely raising and lowering said outer chamber, rods, poles, handles, and handles having an opening configured and positioned to communicate with a venturi.

8. The diffuser of claim 1 wherein said vanes each have a rectangular cross-section.

9. The diffuser of claim 1 wherein said multiple openings collectively have a configuration that facilitates the formation of a Karmen vortex ring in the upwardly-moving exploding gases and debris exiting from said outer chamber that further reduces their energy.

10. The diffuser of claim 1 wherein said opening in said bottom surface of said core structure extends its full width and length dimension.

11. The diffuser of claim 1 wherein said core structure is selected from a group consisting of core structures having a rectangular cross-sectional configuration, core structures having the cross-sectional configuration of a polygon, core structures having an upwardly tapering configuration, core structures that position upwardly directed vanes adjacent to said top surface of said outer chamber, core structures that position upwardly directed vanes near to said top surface of said outer chamber, and core structures that position upwardly directed vanes at a spaced-apart distance below said top surface of said outer chamber.

12. A method for neutralizing the potentially harmful affects of exploding gases and debris resulting from the detonation of a land mine or other exploding device, so that the velocity of the expanding gases is slowed and the laterally moving gases and debris are redirected and forced to travel in a substantially upward direction, said method comprising the steps of:

providing an outer chamber with solid side walls and a top surface with multiple openings therethrough, a core structure with an open bottom, and a plurality of vanes;

attaching said vanes to said core structure with progressive three-degree separation whereby the lowest ones of said vanes are substantially horizontally-extending and the highest ones of said vanes are substantially vertically-extending;

centering said core structure within said outer chamber; and securely attaching said core structure to said outer chamber whereby the velocity of expanding gases from the detonation of an explosive device positioned within said core structure is reduced by said vanes and laterally traveling gases and debris are directed upwardly for release from said outer chamber via said multiple openings in said top surface.

13. The method of claim 12 wherein said solid side walls have an outside surface and further comprising the step of providing a plurality of reinforcement stiffeners and the step of attaching said reinforcement stiffeners to said outside surface.

14. The method of claim 13 further comprising the step of providing the outer chamber with a bottom flange and the step of attaching said reinforcement stiffeners to said bottom flange.

15. The method of claim 12 further comprising the steps of providing a core structure with a venturi, making an opening in said top surface of said outer chamber for introduction into said core structure of ignition causing means adapted for setting off a non-detonated exploding device covered by said core structure, and placing said opening in said top surface of said outer chamber so that it sufficiently communicates with said venturi for prompt movement of all usable ignition causing means downward through said venturi.

16. The method of claim 12 further comprising the step of providing a transport means adapted for facilitated movement of said outer chamber from one needed location to another.

17. The method of claim 16 wherein said transport means is also adapted for reinforcement of said side walls of said outer chamber.

18. The method of claim 12 wherein said vanes each have a rectangular cross-section.

19. The method of claim 12 wherein said multiple openings collectively have a configuration that facilitates the formation of a Karmen vortex ring in the upwardly-moving exploding gases exiting therefrom that further reduces their energy.

20. The method of claim 12 wherein said core structure is selected from a group consisting of core structures having a rectangular cross-sectional configuration, core structures having the cross-sectional configuration of a polygon, core structures having an upwardly tapering configuration, core structures that position upwardly directed vanes adjacent to said top surface of said outer chamber, core structures that position upwardly directed vanes near to said top surface of said outer chamber, and core structures that position upwardly directed vanes at a spaced-apart distance below said top surface of said outer chamber.

* * * * *